US010510485B2

(12) United States Patent
Huss et al.

(10) Patent No.: US 10,510,485 B2
(45) Date of Patent: Dec. 17, 2019

(54) HEAT TRANSFER IN MAGNETIC ASSEMBLIES

(71) Applicant: Hamilton Sundstrand Corporation, Charlotte, NC (US)

(72) Inventors: John Huss, Roscoe, IL (US); William D. Sherman, Kingston, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 340 days.

(21) Appl. No.: 15/358,867

(22) Filed: Nov. 22, 2016

(65) Prior Publication Data

US 2017/0076862 A1 Mar. 16, 2017

Related U.S. Application Data

(62) Division of application No. 14/454,925, filed on Aug. 8, 2014, now abandoned.

(51) Int. Cl.

| | |
|---|---|
| ***H01F 41/12*** | (2006.01) |
| ***H01F 27/22*** | (2006.01) |
| ***H01F 27/02*** | (2006.01) |
| *H01F 27/28* | (2006.01) |
| *H01F 37/00* | (2006.01) |

(52) U.S. Cl.

CPC ..... *H01F 41/125* (2013.01); *H01F 27/022* (2013.01); *H01F 27/025* (2013.01); *H01F 27/22* (2013.01); *H01F 27/2895* (2013.01); *H01F 37/00* (2013.01)

(58) Field of Classification Search

CPC .... H01F 41/005; H01F 41/125; H01F 27/022; H01F 27/025; H01F 27/22

See application file for complete search history.

(56) References Cited

U.S. PATENT DOCUMENTS

| | | | |
|---|---|---|---|
| 3,075,250 | A | 1/1963 | Strohm et al. |
| 6,483,218 | B1 | 11/2002 | Petrinko |
| 7,459,817 | B2 | 12/2008 | VanLuik et al. |
| 2009/0146769 | A1 | 6/2009 | Feng et al. |

FOREIGN PATENT DOCUMENTS

| | | | |
|---|---|---|---|
| CN | 203491042 | U | 3/2014 |
| DE | 20317641 | U1 | 1/2004 |
| EP | 2693612 | A1 | 2/2014 |

OTHER PUBLICATIONS

Extended European Search Report Application No. 15179899.8-1556 / 2985770 dated Jan. 20, 2016.

*Primary Examiner* — Livius R. Cazan

(74) *Attorney, Agent, or Firm* — Locke Lord LLP; Scott D. Wofsy; Joshua L. Jones

(57) ABSTRACT

A magnetic assembly includes a winding and a housing disposed about the winding. The housing includes an interior surface contoured to conform to the winding to facilitate heat transfer between the winding and the housing. A method of manufacturing a magnetic assembly includes forming a contoured interior surface on a housing and assembling a winding into the housing such that the interior surface of the housing conforms to the winding to facilitate heat transfer between the winding and the housing.

12 Claims, 3 Drawing Sheets

HEAT TRANSFER IN MAGNETIC ASSEMBLIES

CROSS-REFERENCE TO RELATED APPLICATIONS

This application is a divisional of U.S. patent application Ser. No. 14/454,925 filed Aug. 8, 2014, which is incorporated by reference herein in its entirety.

BACKGROUND OF THE INVENTION

1. Field of the Invention

The present disclosure relates to magnetic assemblies, and more particularly to heat transfer in magnetic assemblies.

2. Description of Related Art

A traditional magnetic assembly includes a wound magnetic core with copper windings placed in a metal housing. This assembly is typically potted with thermally conducting, electrically insulating material. During operation, such assemblies generate heat in amounts that must be dissipated to avoid damaging the components. Due to the need to electrically insulate the wires, and due to manufacturing tolerances, the potting material is typically used liberally to bridge the gap between the housing, which serves as a heat sink, and the windings and core. The length of the thermal path through the potting material, and the relatively low thermal conductivity of the potting material, limit operation capacity of the assembly due to the risk of overheating.

Such conventional methods and systems have generally been considered satisfactory for their intended purpose. However, there is still a need in the art for improved heat transfer in magnetic assemblies. The present disclosure provides a solution for this need.

SUMMARY OF THE INVENTION

A magnetic assembly includes a winding and a housing disposed about the winding. The housing includes an interior surface contoured to conform to the winding to facilitate heat transfer between the winding and the housing.

The interior surface of the housing can be spaced apart from the winding with a substantially constant gap width between the winding and the interior surface. The gap can be configured to electrically insulate the winding from the housing. A potting material can be disposed between the winding and the interior surface of the housing for electrical insulation between the winding and the housing, and for thermal conduction between the winding and the housing. It is contemplated that the interior surface of the housing can be contoured to conform to individual strands of the winding. A magnetic core can be included, wherein the winding is a copper winding wound about the magnetic core, and wherein the housing includes aluminum, for example.

A method of manufacturing a magnetic assembly includes forming a contoured interior surface on a housing and assembling a winding into the housing such that the interior surface of the housing conforms to the winding to facilitate heat transfer between the winding and the housing.

The method can include determining the outer contour of the winding, wherein forming a contoured interior surface includes forming the contoured interior surface to have a substantially constant gap width between the winding and the interior surface. It is also contemplated that the method can include disposing potting material between the winding and the interior surface of the housing for electrical insulation between the winding and the housing and for thermal conduction between the winding and the housing. In another aspect, forming a contoured interior surface can include forming the contoured interior surface to match the contour determined for the winding, e.g., forming the contoured interior surface to conform to individual strands of the winding.

In another aspect, determining the outer contour of the winding can include using rapid scanning. Forming the contoured interior surface can include using additive manufacturing, computer numerical control (CNC) machining, or the like, to form the contoured interior surface based on the outer contour determined using rapid scanning.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
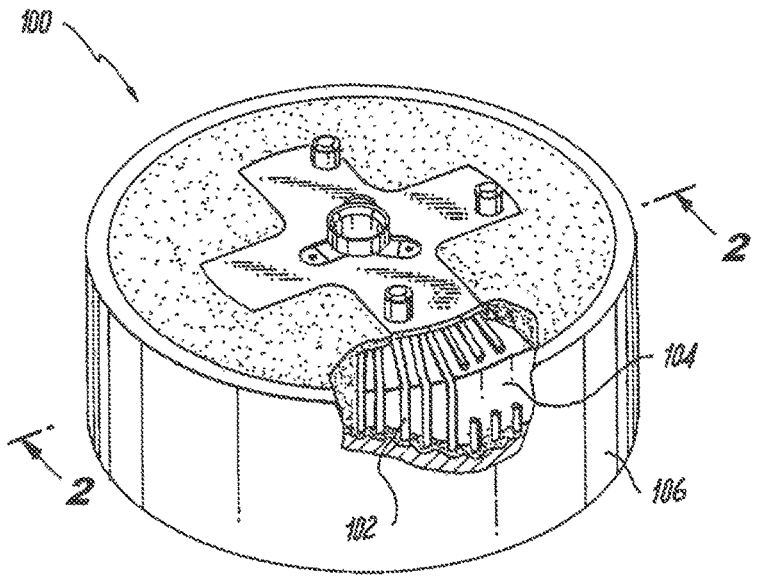
FIG. 1 is a cut away perspective view of an exemplary embodiment of a magnetic assembly constructed in accordance with the present disclosure, showing the housing, the core, and the winding.

Reference will now be made to the drawings wherein like reference numerals identify similar structural features or aspects of the subject disclosure. For purposes of explanation and illustration, and not limitation, a partial view of an exemplary embodiment of a magnetic assembly in accordance with the disclosure is shown in FIG. 1 and is designated generally by reference character 100. Other embodiments of magnetic assemblies in accordance with the disclosure, or aspects thereof, are provided in FIGS. 2-3 and 5, as will be described. The systems and methods described herein can be used to provide an improvement in heat transfer for magnetic assemblies.

Magnetic assembly 100 includes a winding 102 wound about the magnetic core 104 and a housing 106 disposed about winding 102. Magnetic assembly 100 can be used, for example, as an inductor in an electrical system. Winding 102 can be a copper winding, and housing 102 can be made of aluminum, for example.

Figure 2:
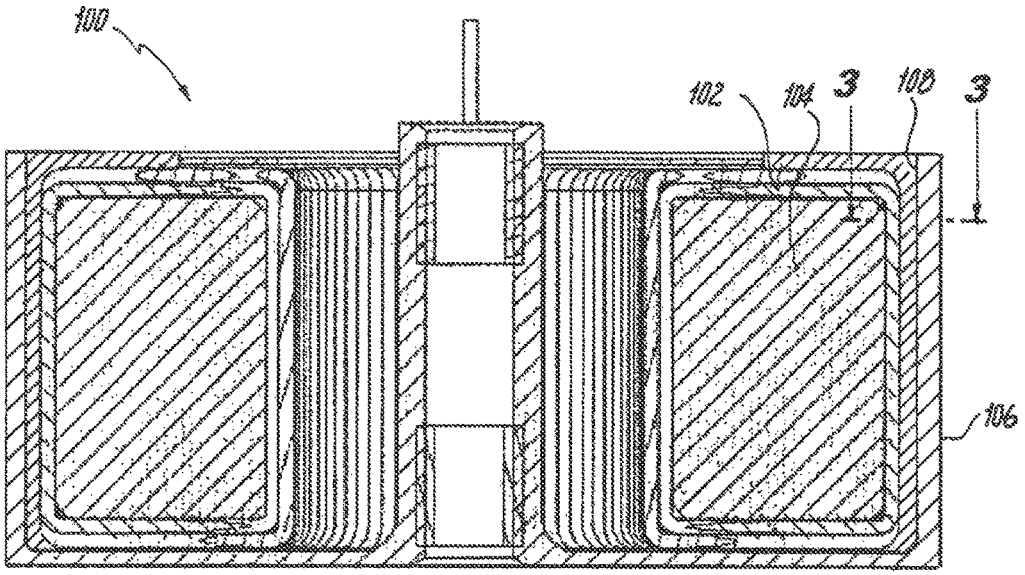
FIG. 2 is a cross-sectional elevation view of the magnetic assembly of FIG. 1, showing the cross-section identified in FIG. 1.
Figure 3:
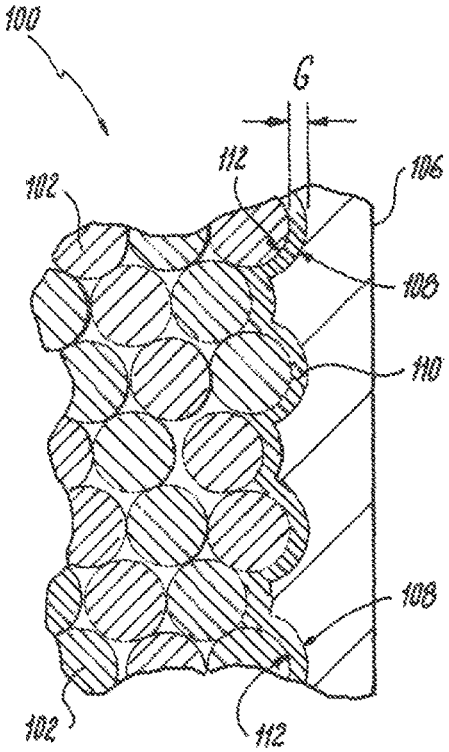
FIG. 3 is a cross-sectional elevation view of a portion of the magnetic assembly of FIG. 2, showing the portion indicated in FIG. 2.

As indicated in FIG. 2, housing 106 includes an interior surface 108 proximate winding 102. FIG. 3 is an enlargement of the portion of magnetic assembly indicated in FIG.

2, showing that interior surface 108 is contoured to conform to winding 102 to facilitate heat transfer between winding 102 and housing 106.

Interior surface 108 of housing 106 is spaced apart from winding 102 with a substantially constant gap width G between winding 102 and interior surface 108. Gap width G is taken normal to opposed positions of surface 108 and the outer surface 112 of winding 102. FIG. 3 only shows one exemplary position of Gap with G. Gap width G can be configured, e.g., sized and/or toleranced, to electrically insulate winding 102 from housing 106, and need be no thicker than needed to provide adequate electrical insulation. A potting material 110 is disposed in the gap between winding 102 and interior surface 108 of housing 106 to insulate the wire strands of winding 102 and for electrical insulation between winding 102 and housing 106. Potting material 110 also provides a path for thermal conduction between winding 102 and housing 106. As shown in FIG. 3, interior surface 108 of housing 106 is contoured to conform to individual wire strands of winding 102.

Figure 4:
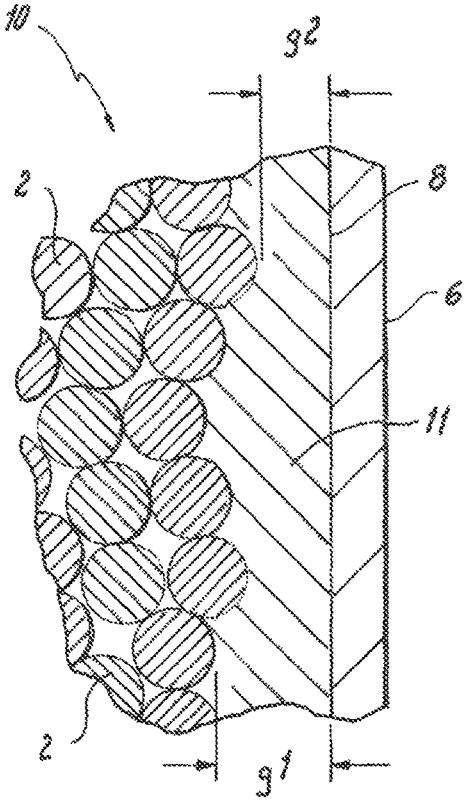
Fig. 4 (Prior Art)
FIG. 4 is a cross-sectional elevation view of a portion of a prior art magnetic assembly for comparison to FIG. 3.

With reference now to FIG. 4, a portion of a traditional magnetic assembly 10 is shown. The housing 6 has an interior surface 8 that is not contoured to match the outer surface of winding 2. As a result, the potting material 11 has a variable thickness as demonstrated by the gap widths g1 and g2, which have considerably different lengths. In order to ensure adequate electrical insulation at the shallow portions, e.g., at gap width g2, there has to be considerably more potting material than is needed strictly for electrical insulation at the deeper portions, e.g., at gap width g1. As a result, there is considerably more thermal insulation at the thicker portions of potting material 11, e.g., at gap g1 than at the thinner portions, e.g., gap g2.

By contrast, in accordance with this disclosure, magnetic assembly 100 of FIG. 3 has considerably less potting material, and therefore less thermal insulation between windings 102 and housing 106, than a traditional magnetic assembly 10. The overall thermal path for magnetic assembly 100 is much shorter than for traditional configurations. Moreover, the surface area of the interior surface 108 is increased considerably compared to that in the traditional configuration of FIG. 4, which enhances heat transfer into interior surface 108 by comparison. Magnetic assembly 100 therefore has significantly better heat transfer capabilities between windings 102 and housing 106 than in traditional magnetic assemblies such as that shown in FIG. 4. Another potential advantage of the reduced gap in FIG. 3 is that housing 106 can be made smaller than traditional housings for the same size of windings.

Figure 5:
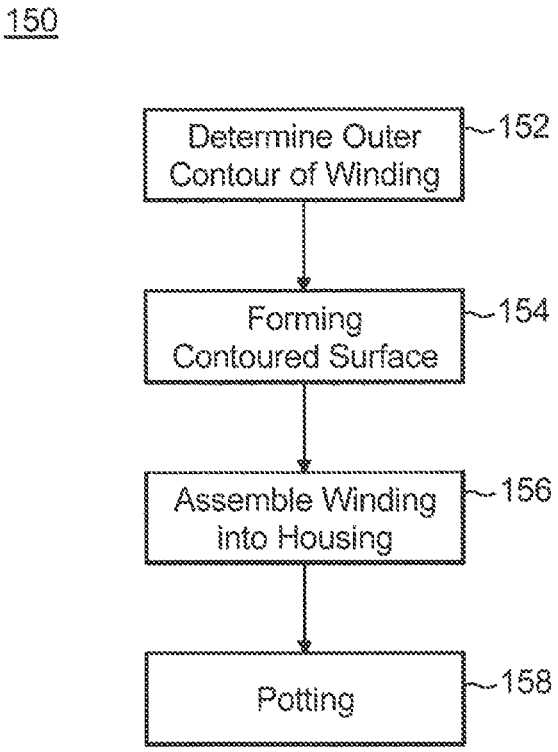
FIG. 5 is a schematic diagram of an exemplary embodiment of a method in accordance with the present disclosure.

Referring now to FIG. 5, a method 150 of manufacturing a magnetic assembly such as magnetic assembly 100 is diagramed. Method 150 includes determining the outer contour of a winding, e.g., winding 102, as indicated by box 152. This can include using rapid scanning to create a model of the outer surface of the winding. Using a predetermined gap width, e.g., gap width G, the model can be used to determine the geometry of for the interior surface, e.g., interior surface 108, of the housing, e.g., housing 106.

Method 150 includes forming a contoured interior surface on a housing, as indicated by box 154. Forming a contoured interior surface can include forming the contoured interior surface to have a substantially constant gap width, e.g., gap width G, between the winding and the interior surface. This can include using the geometry determined from the model of the outer surface of the winding, with an offset for the constant gap width to form the contoured interior surface to match the contour determined for the winding. Forming the contoured interior surface can include conform the interior surface to individual strands of the winding, as shown in FIG. 3. The interior surface can be formed using additive manufacturing, computer numerical control (CNC) machining, or the like, to form the contoured interior surface based on the geometry derived from rapid scanning the outer contour of the winding. When manufacturing multiple magnetic assemblies, the process of determining the outer contour of the winding and forming a conforming interior surface in a housing can be repeated for each unit manufactured, so each magnetic assembly has a housing custom fit to the respective winding.

With the contoured interior surface formed, the winding can be assembled into the housing such that the interior surface of the housing conforms to the winding, as indicated by box 156. Potting material, e.g., potting material 110, can be disposed between the winding and the interior surface of the housing, as indicated by box 158.

The methods and systems of the present disclosure, as described above and shown in the drawings, provide for magnetic assemblies with superior properties including enhanced heat transfer. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. A method of manufacturing a magnetic assembly comprising:

determining an outer contour of a winding by three-dimensionally scanning the outer contour of the winding;

forming a contoured interior surface on a housing; and assembling the winding into the housing such that the interior surface of the housing conforms to the winding to facilitate heat transfer between the winding and the housing.

2. A method as recited in claim 1, further comprising:

determining the outer contour of the winding, wherein forming a contoured interior surface includes forming the contoured interior surface to have a substantially constant gap width between the winding and the interior surface.

3. A method as recited in claim 2, further comprising:

further comprising disposing potting material between the winding and the interior surface of the housing for electrical insulation between the winding and the housing and for thermal conduction between the winding and the housing.

4. A method as recited in claim 1, further comprising:

determining the outer contour of the winding, wherein forming a contoured interior surface includes forming the contoured interior surface to match the contour determined for the winding.

5. A method as recited in claim 1, wherein forming the contoured interior surface includes forming the contoured interior surface to conform to individual strands of the winding.

6. A method as recited in claim 1, wherein forming the contoured interior surface includes using additive manufacturing to form the contoured interior surface based on the outer contour determined.

7. A method as recited in claim 1, wherein forming the contoured interior surface includes using computer numerical control (CNC) machining to form the contoured interior surface based on the outer contour determined.

8. A method of manufacturing a magnetic assembly comprising:

determining an outer contour of a winding by three-dimensionally scanning the outer contour of the winding;

forming a contoured interior surface on a housing; assembling the winding into the housing such that the interior surface of the housing conforms to the winding to facilitate heat transfer between the winding and the housing; and determining the outer contour of the winding, wherein forming a contoured interior surface includes forming the contoured interior surface to have a substantially constant gap width between the winding and the interior surface, wherein forming the contoured interior surface includes forming the contoured interior surface to conform to individual strands of the winding.

9. A method as recited in claim 8, further comprising:

further comprising disposing potting material between the winding and the interior surface of the housing for electrical insulation between the winding and the housing and for thermal conduction between the winding and the housing.

10. A method as recited in claim 8, further comprising:

determining the outer contour of the winding, wherein forming a contoured interior surface includes forming the contoured interior surface to match the contour determined for the winding.

11. A method as recited in claim 8, wherein forming the contoured interior surface includes using additive manufacturing to form the contoured interior surface based on the outer contour determined.

12. A method as recited in claim 8, wherein forming the contoured interior surface includes using computer numerical control (CNC) machining to form the contoured interior surface based on the outer contour determined.

* * * * *